United States Patent [19]

Shoemaker

[11] Patent Number: 4,570,929

[45] Date of Patent: Feb. 18, 1986

[54] PLASTIC EXERCISING DEVICE AND ITS METHOD OF MANUFACTURE

[75] Inventor: Nancy A. Shoemaker, Woodbridge, Va.

[73] Assignee: Trim, Inc., Woodbridge, Va.

[21] Appl. No.: 528,131

[22] Filed: Aug. 31, 1983

[51] Int. Cl.[4] ..... A01B 23/00

[52] U.S. Cl. ..... 272/137; 272/143; 112/262.1; 112/413; 428/102

[58] Field of Search ..... 272/137, 142, 143, 125, 272/126, 135; 428/192, 102; 119/126; 28/94; 2/338, 240; 224/218, 219, 222, 250; 112/262.1, 262.2, 413

[56] References Cited

U.S. PATENT DOCUMENTS

| | | | |
|---|---|---|---|
| 2,007,410 | 7/1935 | Spence | 112/262.1 |
| 3,119,614 | 1/1964 | Berry | 272/125 |
| 3,275,205 | 9/1966 | Howd | 128/94 |
| 3,277,855 | 10/1966 | Roing | 112/413 |
| 3,599,243 | 8/1971 | Sivel | 2/338 |
| 3,819,177 | 6/1974 | Spiro | 272/137 |
| 3,838,852 | 10/1974 | Gury | 272/137 |
| 4,085,872 | 4/1978 | Foo | 224/223 |
| 4,137,352 | 1/1979 | Stonebridge | 428/192 |
| 4,200,281 | 4/1980 | Wang | 272/142 |
| 4,273,328 | 6/1981 | Ozbey | 272/137 |

OTHER PUBLICATIONS

Washington Post 7/3/83, advertizement entitled Synometrics of Speed Shaper Inc. NY NY.

"Black Master" advertizement on P47 of Black Belt Magazine 5-1980.

*Primary Examiner*—Richard J. Johnson

*Attorney, Agent, or Firm*—Stevens, Davis, Miller & Mosher

[57] ABSTRACT

Disclosed is an elastic exercising device comprising a central elongated portion made of stretchable, flexible resistance material and handles provided at opposite ends of the elongated portion, the handles being connected to the central portion and being formed as loops of the stretchable, flexible resistance material through which a user can insert his hands.

7 Claims, 3 Drawing Figures

PLASTIC EXERCISING DEVICE AND ITS METHOD OF MANUFACTURE

BACKGROUND OF THE INVENTION

1. Field of the Invention

The present invention relates to an elastic exercising device and, more particularly, to a hand-held elastic exercising device which is stretched during use by a user to provide elastic resistance, which helps tone muscles and build muscle strength.

2. Discussion of the Prior Art

Various elastic exercising devices are known which can be stretched or pulled by a user to tone or build body muscles. Often, these devices use one or more tightly coiled springs having handles attached at their opposite ends. When the handles are pulled apart, the springs are stretched, providing resistance against further stretching which is overcome by force produced by a user's muscles. Typically, the springs are stretched and relaxed many times during an exercise routine. A problem with spring-based devices is that they are inherently heavy, bulky and clumsy to work with. In addition, the device construction tends to be complicated and the handles, which are gripped by a user, become slippery when used due to user perspiration, making it difficult for a user to maintain a sure and steady grip on the apparatus. If a grip is lost when the springs are stretched, an injury may result.

Other resistance devices use rubber or other elastic materials which have handles fastened at opposite ends. While such devices are generally not as heavy and bulky as spring-based devices, the handles are still a problem in that they may become slippery in use, making it difficult to maintain a sure and steady grip.

SUMMARY OF THE INVENTION

The present invention is designed to provide an elastic exercising device which overcomes the above-noted difficulties with prior known devices.

Accordingly, one object of the invention is the provision of an elastic exercising device which has s simple and inexpensive construction, which is easy to store and use, and which has handles which provide a surer and safer non-slip grip for a user.

These and other objects, advantages and features of the invention are achieved in the invention by constructing the exercising device of a piece of elongated flat flexible elastic material which is looped at its respective ends and secured to itself to form integral, flexible handles through which the hands of a user can be inserted. The flexible handles are stretched upon the insertion of a user's hands therein to provide an elastic, flexible grip which is easily grasped and held by a user. The device is conveniently and easily made by folding and sewing a single piece of elongated flat flexible elastic material.

A more detailed description of the invention is presented below in connection with the accompanying drawings.

DETAILED DESCRIPTION OF THE INVENTION

Figure 1:
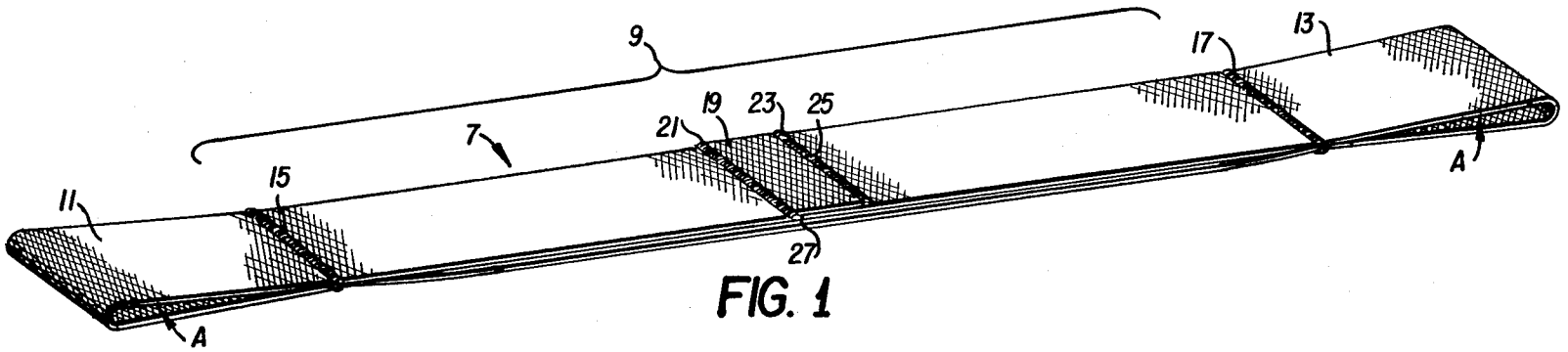
FIG. 1 illustrates in perspective view one embodiment of an exercising device constructed in accordance with the invention.

FIG. 1 shows one embodiment of an exercising device of the invention. The device 7 is formed of a piece of elongated flat, flexible elastic material which can be folded and sewn into the shape shown.

The device includes a central portion 9 which terminates at its opposite ends in a pair of handles 11 and 13, respectively formed as folded over loops in the elastic material. The folded material forming the handles 11 and 13 is stitched or otherwise fastened to itself widthwise along lines 15 and 17. The central portion 9 is formed of one or more layers of the same elastic material as that which forms the handles, and both the central portion 9 and handles 11 and 13 have the same width.

Figure 3:
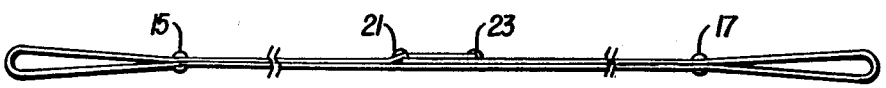
FIG. 3 illustrates in side view additional steps in the method of constructing the FIG. 1 embodiment.
Figure 2:
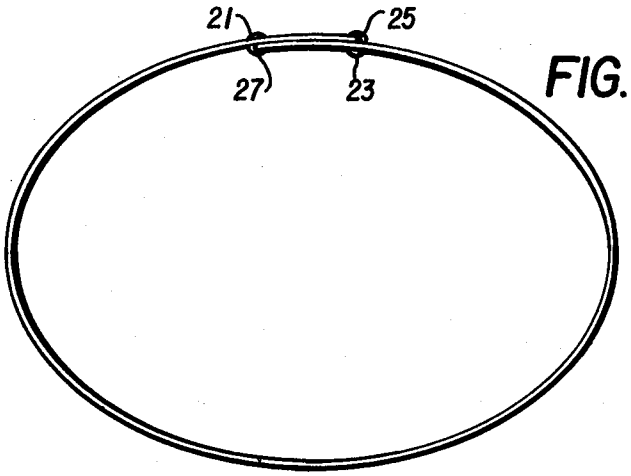
FIG. 2 illustrates in side view a first step in the method of constructing the FIG. 1 embodiment.

The entire device is preferably formed of a single piece of elongated, flat, flexible elastic material which is first end-connected by overlapping end portions 25 and 27 of the material and fastening them together, as by stitching along lines 21 and 23, as shown in FIG. 2. This forms a single loop of the elastic material. This loop can then be flattened by pressing opposing sides together, as shown in FIG. 3, following which the handles 11 and 13 are formed by fastening, e.g., stitching the overlapped layers of material together along lines 15 and 17.

The elastic material is a fabric-like material which is a commercially available elastic waistband material. This material is easily sewn and is available in numerous widths from sewing supply centers and fabric stores. One suitable material is available from Stretch and Sew fabric centers as a 2" wide elastic strip. It is formed of approximately 25% rubber and 75% cotton and has a 100% manual stretch at 30% tension with a four pound weight. Of course, other flat, strip-like elastic materials can also be used.

The device illustrated in FIG. 1 can be constructed from a 2" wide strip of flexible elastic material approximately 64" in length. When folded and fastened into the exercising device illustrated, the device will be approximately 31–32" long and have a central portion 9 of approximately 24" and handles, each approximately 4" long.

The handles 11 and 13 can be made slightly smaller in interior peripheral dimension than the anticipated size of the hand of a user so that the elasticity of the material grips a user's hands when they are inserted into handles 11 and 13. This, as well as the fact that the elastic material has an unsmooth (rough) non-slippery fabric-like surface, ensures that the handles 11 and 13 will not slip off the hands of a user even during vigorous exercise.

To use the exercising device of the invention, a user slides his hands, fingers first, through the loops of handles 11 and 13 in the direction shown by arrows A, until the handles 11 and 13 surround the palms and backsides of both hands. He can then close his fist and securely and reliably grab the ends of the exercising device. Since the handles are made of a flexible fabric-like material, there is little chance of slippage, even during vigorous exercise activity. Moreover, the flexible handles are comfortable and readily conform to a user's hands, making them less fatiguing to grip even after prolonged use of the exercise device. Of course, exercising occurs by pulling the handles apart against the resistance offered by the elasticity of the device. The exercising device of FIG. 1 has been found to be particularly beneficial when used in stretching exercises performed in connection with aerobic activity.

While a preferred embodiment of the invention and a manner of making it have been shown and described, it should be apparent that many modifications can be made without departing from the spirit and scope of the invention. Accordingly, the invention is not limited by the foregoing description, but is only limited by the scope of the appended claims.

I claim:

1. A resistance exercise device comprising:

a central elongated portion made of stretchable, flexible flat resistance material and handles provided at opposite ends of said elongated portion, said handles being connected to said central portion and being formed as loops of said material through which a user can insert his hands, said central portion and said handles being formed of a single elongated piece of said material having a uniform predetermined width which has its ends fastened together to form a loop, with said handles being formed by opposing portions of said loop being fastened together at opposite ends of said loop, said central portion being formed by two overlapping plies of said material.

2. A resistance exercise device as in claim 1, wherein said resistance material has a rough fabric-like surface.

3. A resistance exercise device as in claim 1, wherein the fastening of said ends is by stitching.

4. A resistance exercise device as in claim 1, wherein said opposing portions are fastened together by stitching.

5. A method of forming an elastic exercising device comprising the steps of forming an elongated strip of flat stretchable resistance material having a predetermined width into a loop by fastening together ends of said material strip, pressing opposing faces together, and fastening said opposing faces together to form a device having a central elongated portion and respective handle loops at opposite ends of said central portion.

6. A method as in claim 5, wherein said fastening is by stitching said resistance material.

7. A method as in claim 5, wherein said material has a rough fabric-like surface.

* * * * *

UNITED STATES PATENT AND TRADEMARK OFFICE

CERTIFICATE OF CORRECTION

PATENT NO. : 4,570,929

DATED : February 18, 1986

INVENTOR(S) : Nancy A. SHOEMAKER

It is certified that error appears in the above-identified patent and that said Letters Patent is hereby corrected as shown below:

PLEASE CHANGE THE FIRST WORD OF THE TITLE OF THE INVENTION TO "ELASTIC" NOT -- PLASTIC --.

Signed and Sealed this

Ninth Day of December, 1986

*Attest:*

DONALD J. QUIGG

*Attesting Officer*

*Commissioner of Patents and Trademarks*